US011280054B2

(12) United States Patent
Mahler et al.

(10) Patent No.: US 11,280,054 B2
(45) Date of Patent: Mar. 22, 2022

(54) COMPACTOR

(71) Applicant: Hamm AG, Tirschenreuth (DE)

(72) Inventors: Gerhard Mahler, Windischeschenbach (DE); Marco Kreger, Tirschenreuth (DE); Stefan Greger, Neusorg (DE); Thomas Gradl, Tirschenreuth (DE)

(73) Assignee: HAMM AG, Tirschenreuth (DE)

( * ) Notice: Subject to any disclaimer, the term of this patent is extended or adjusted under 35 U.S.C. 154(b) by 0 days.

(21) Appl. No.: 17/000,923

(22) Filed: Aug. 24, 2020

(65) Prior Publication Data

US 2021/0062446 A1 Mar. 4, 2021

(30) Foreign Application Priority Data

Aug. 26, 2019 (DE) ..... 10 2019 122 811.5

(51) Int. Cl.
*E01C 19/23* (2006.01)
*E02D 3/046* (2006.01)
*E01C 19/28* (2006.01)

(52) U.S. Cl.
CPC ..... *E02D 3/046* (2013.01); *E01C 19/235* (2013.01); *E01C 19/236* (2013.01); *E01C 19/286* (2013.01)

(58) Field of Classification Search
CPC ..... E02D 3/046; E01C 19/235; E01C 19/236; E01C 19/286
USPC ..... 404/77, 79, 95, 117, 132
See application file for complete search history.

(56) References Cited

U.S. PATENT DOCUMENTS 3,007,379 A 11/1961 Ellis
3,066,585 A 12/1962 Cumpton
3,068,765 A * 12/1962 Caufield ..... E01C 19/238 404/95
3,331,297 A * 7/1967 Bettino ..... E01C 19/238 404/95
3,807,886 A * 4/1974 Cutler ..... F23D 91/02 404/77
4,157,877 A * 6/1979 Lee ..... E01C 19/231 172/395
5,895,172 A * 4/1999 Grembowicz ..... E01C 19/48 404/79
6,361,246 B1 * 3/2002 Tamura ..... E01C 19/26 404/122

(Continued)

FOREIGN PATENT DOCUMENTS

CN 107503271 12/2017
DE 7244979 3/1973
DE 102008024488 1/2009

(Continued)

OTHER PUBLICATIONS

German Search Report dated Jun. 16, 2020.
European Search Report filed in EP 20187332 dated Dec. 11, 2020.

*Primary Examiner* — Raymond W Addie
(74) *Attorney, Agent, or Firm* — Rankin, Hill & Clark LLP

(57) ABSTRACT

A compactor includes a compactor structure and at least one roller unit rotatably supported on the compactor structure about a roller axis of rotation. A roller heater is deployed in assignment with at least one roller unit. The roller heater is a liquid fuel-operated heating device with a burner region, a fuel pump for supplying liquid fuel from a fuel tank to the burner region and a combustion air blower for supplying combustion air to the burner region.

12 Claims, 3 Drawing Sheets

(56) References Cited

U.S. PATENT DOCUMENTS

2016/0076206 A1* 3/2016 Ries ..... E01C 19/264
404/72

FOREIGN PATENT DOCUMENTS

| | | |
|---|---|---|
| EP | 3258013 | 12/2017 |
| JP | H08134827 | 5/1996 |
| JP | 2016075043 | 5/2016 |

* cited by examiner

COMPACTOR

The present invention relates to a compactor with which the base material of a ground surface, for example asphalt, can be compacted.

Especially when compacting asphalt, there is the problem that when driving over the asphalt to be compacted, parts of the material can adhere to the outer circumferential surface of the roller units of the compactors used for compacting. The tendency to adhere to the roller units is particularly pronounced when such roller units comprise a plurality of rubber wheels disposed one after the other in the direction of a roller axis of rotation.

To counteract this problem, it is known, for example, from EP 3 258 013 A1, to trace a mixture of release agent and water onto the surface of such rubber wheels.

Another approach to avoid asphalt adhesion is to heat the surfaces of the roller units driving over the asphalt. For this purpose, for example, JP 27623294 A discloses directing hot combustion exhaust gas, which is expelled from the drive assembly of a compactor designed as an internal combustion engine, onto the outer circumferential surface of the rubber wheels of a roller unit. DE 7244979 U discloses heating the outer circumferential surface of a roller unit by means of a flame fed from a gas bottle and generated in a propane gas burner.

It is the object of the present invention to provide a compactor with at least one roller unit, in which, with a compact structure, an efficient heating of the outer circumferential surface of at least one roller unit which comes into contact with the material to be compacted can be achieved.

According to the invention, this object is achieved by a compactor, comprising a compactor structure and at least one roller unit rotatably supported on the compactor structure about a roller axis of rotation, wherein a roller heater is deployed in assignment with at least one roller unit, wherein the roller heater is a liquid fuel-operated heating device with a burner region, a fuel pump for supplying liquid fuel from a fuel tank to the burner region and a combustion air blower for supplying combustion air to the burner region.

In the compactor constructed according to the invention, a heating device fed with liquid fuel is used to provide the heat to be transferred to a roller unit. Such heating devices are used, for example, as auxiliary heaters or independent heaters in passenger vehicles, commercial vehicles and buses, in order to provide heat in addition to or independently of the operation of a drive assembly designed as an internal combustion engine, by means of which, for example, a coolant circuit and/or an interior of a vehicle can be heated. Such a fuel-operated heating device can therefore provide heat in a compactor constructed according to the invention independently of the operation of a drive assembly of the compactor, so that it is possible to heat a roller unit, which is assigned such a roller heater, even before the drive assembly is started up and adapted to the actual heat requirement. It is also possible to feed fuel to such a heating device, which can also be used for the drive assembly of the compactor. There is therefore no need to provide an additional fuel tank for the heating device This can be fed from the same tank from which the drive assembly is also fed.

In order to be able to transfer the heat generated in the heating device in the combustion process, in particular by heat radiation, to an assigned roller unit, it is proposed that the roller heater further comprises a heating element absorbing combustion exhaust gas emitted by the burner region and emitting heat in the direction of the roller unit.

In order to absorb heat transported in the combustion exhaust gas to the heating element, an exhaust gas flow volume with a combustion exhaust gas from the inlet region absorbing the burner region and a combustion exhaust gas emitting to the outside can be formed therein.

In order to avoid direct exposure to the surface of a roller unit with very hot combustion exhaust gas, depending on the heating power of the heating device, a flow of combustion exhaust gas leaving the exhaust gas flow volume cannot be directed substantially towards the assigned roller unit.

In this case, an efficient thermal interaction can be achieved, for example, in that the exhaust gas flow volume comprises a flow channel which runs at least in regions in a meandering manner.

In order to avoid heat losses as far as possible and thus to support an efficient transfer of heat to the roller unit assigned to a roller heater, the exhaust gas flow volume can be delimited on at least one side facing away from the assigned roller unit by an insulation wall of the heating element. Such an insulation wall can be constructed or covered with material which largely precludes heat emission through heat conduction and also through heat radiation. For example, such an insulation wall can be constructed with insulating material that is also used in vehicle construction for the thermal insulation of components or interior spaces.

To emit heat in the direction of the roller unit assigned to a roller heater, it is proposed that the heating element comprises a heat emission surface positioned facing the assigned roller unit.

The heat emission surface can be provided at least partially on a heat transfer wall of the heating element which delimits the exhaust gas flow volume. Such a heat transfer wall is thus advantageously constructed with a material which is a good thermal conductor and also supports the emission of radiation heat, such as sheet metal material.

At least one roller unit can comprise a plurality of rubber wheels which can be rotated about the roller axis of rotation of this roller unit, wherein the roller unit comprising a plurality of rubber wheels is assigned a roller heater. Alternatively or additionally, at least one roller unit can comprise a metal jacket, wherein the roller unit comprising a metal jacket is assigned a roller heater. It is thus clear that the principles of the present invention can be applied to any type of roller unit, regardless of whether these are constructed on their outer circumferential region that comes into contact with the material to be compacted with rubber material or metal material.

If at least one roller heater is disposed on a side of the assigned roller unit facing away from the compactor structure in a longitudinal direction of the compactor, it is possible on the one hand to accommodate such a roller heater in a region in which mutual interference with other components of the compactor can be largely ruled out. Furthermore, with such a positioning, a roller heater can also help encapsulate a roller unit to be heated in such a way that heat losses can be minimised.

In order to be able to provide the energy required for moving the compactor in particular, a drive assembly can be deployed on the compactor structure. It should be pointed out that, within the meaning of the present invention, the heating device generating heat by the generation of combustion exhaust gas is not a drive assembly, since it does not supply the energy for driving any system regions of a compactor to be moved, or is not provided by a drive assembly. The heating device used to provide the heat to be transferred to a roller unit and the drive assembly to provide the energy for moving the compactor or system regions thereof, such as for example imbalances deployed in a roller unit, are constructed separately from one another and can also be operated independently of one another with regard to the functions to be performed by them.

In particular if the drive assembly is designed as an internal combustion engine, the drive assembly and the heating device of the at least one roller heater can be fed from the same fuel tank. This avoids the need to provide an additional fuel tank for the heating device, although this is also possible if, on the one hand, the construction space required for this is available on a compactor, and on the other hand, for example, there is a need to keep a comparatively large amount of fuel available for the operation of the compactor.

A particular advantage of such a heating device to be fed with liquid fuel is that the metered supply of fuel and the correspondingly metered supply of combustion air enable the amount of the mixture to be burned and thus the heating output provided in the combustion mode to be set exactly. This makes it possible to match the heating output of such a heating device to the actual heating requirement. In order to be able to determine this heat requirement, it is proposed that, in assignment with at least one roller unit, a temperature detection arrangement is deployed for detecting a temperature in the region of a roller surface, and that the heating device of the roller heater assigned to this roller unit can be operated on the basis of a roller surface temperature detected by the temperature detection arrangement.

In the case of the compactor constructed according to the invention, in order to avoid overheating due to operation of a roller heater which is too long or too intensive, it is further proposed that at least one overheating sensor be deployed, wherein if a temperature detected by the at least one overheating sensor exceeds an assigned temperature threshold, at least one roller heater deployed in assignment with a roller unit can be deactivated.

The present invention is described in detail below with reference to the accompanying figures. In which.

Figure 1:
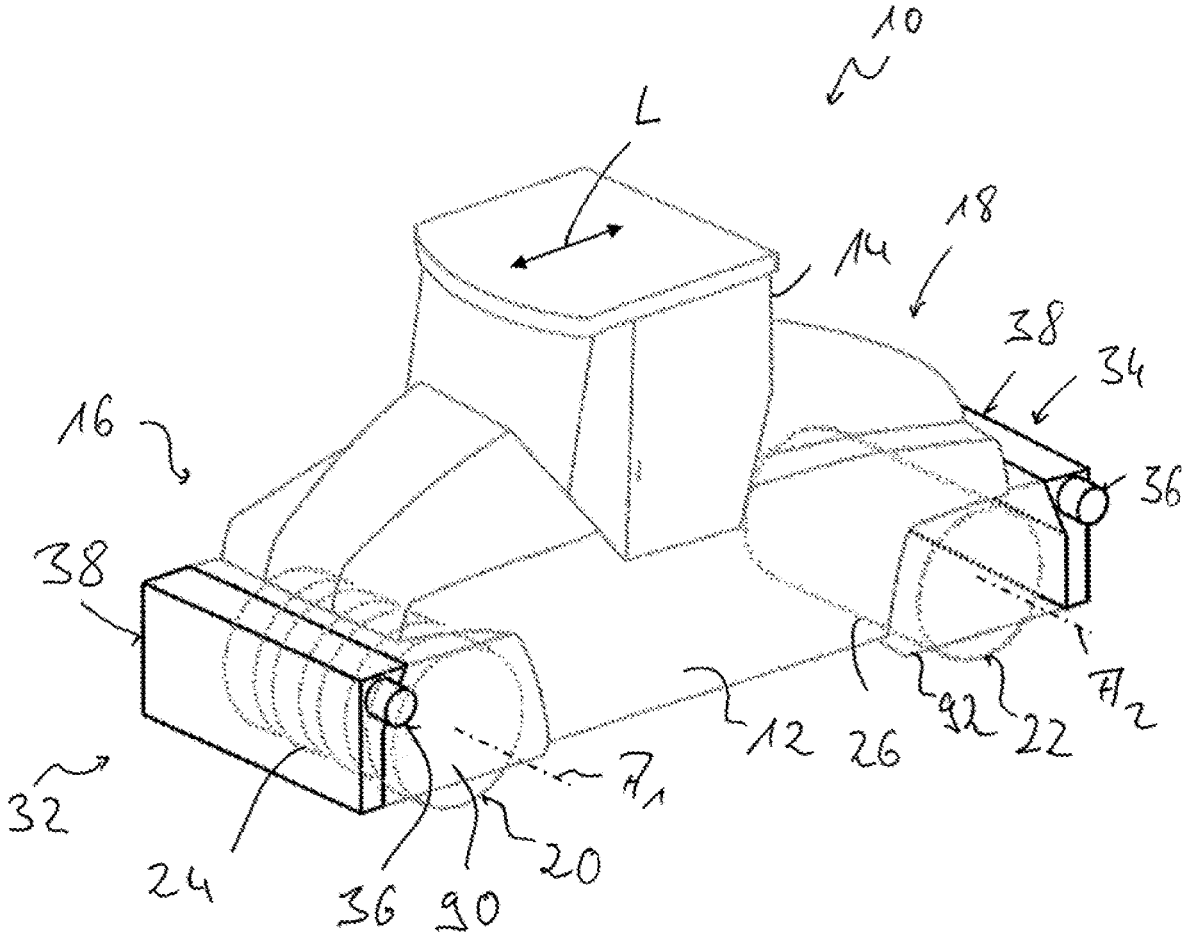
FIG. 1 shows a basic illustration of a compactor with two roller units and roller heaters assigned to these.
Figure 2:
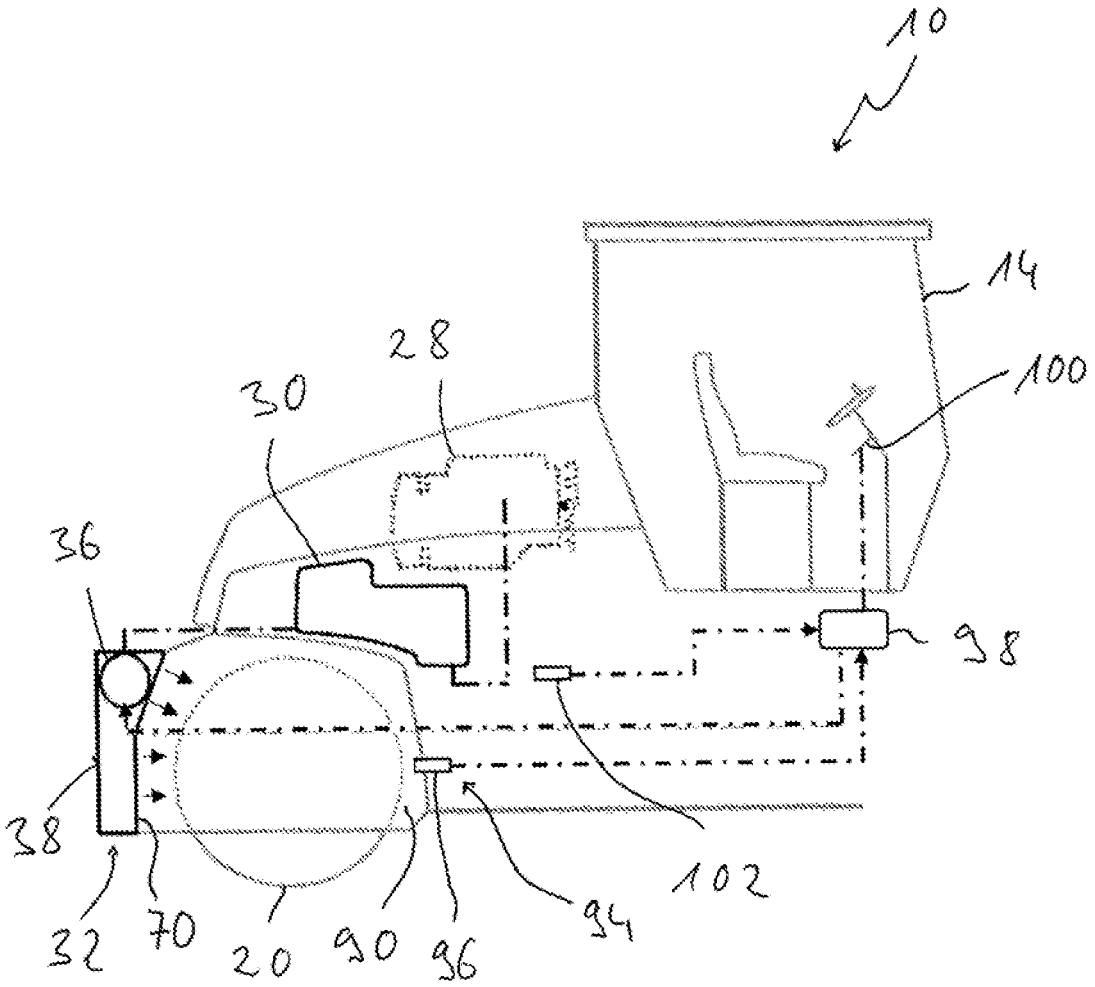
FIG. 2 shows the rear region of the compactor of FIG. 1 with a drive assembly of the compactor deployed thereon.

FIGS. 1 and 2 show a compactor generally designated 10. The compactor 10 comprises a compactor structure 12, on which an operating station 14 is deployed in a region which is substantially central in a longitudinal direction L of the compactor. At the end regions 16, 18 of the compactor structure 12 lying in the longitudinal direction L of the compactor, roller units 20, 22 are rotatably supported about respective roller axes of rotation A1 and A2. The roller unit 20 deployed in the end region 16 comprises a plurality of rubber wheels 24 disposed one after the other in the direction of the roller axis of rotation A1. In the illustrated embodiment example, the roller unit 22 is designed as a compactor roller which runs through in the direction of the roller axis of rotation A2 and has a jacket 26 constructed with metal material. It should be pointed out that the roller unit 22 with the jacket 26 constructed of metal material could also be a split roller unit which comprises two segments which can be rotated in succession about the roller axis of rotation A2 in the direction of the roller axis of rotation A2. At least one of the two roller units 20, 22 can be driven to move the compactor 10 in the longitudinal direction L for rotation about the respectively assigned roller axis of rotation A1, A2. For this purpose, a drive assembly 28 designed as an internal combustion engine is deployed on the compactor structure 12. The drive assembly 28 is fed with fuel from a fuel tank 30 and drives, for example, one or more hydraulic pumps of a hydraulic circuit, via which the drive energy is also transmitted to the driven roller units 20 or/and 22.

It should be pointed out that the compactor 10 can be constructed conventionally in the region of its compactor structure 12. For example, the compactor structure 12 may comprise a front section and a rear section that are pivotable relative to each other about a steering axis to steer the compactor 10. For steering, however, at least one of the roller units 20, 22 could also be supported on the compactor structure 12 so as to be pivotable about a steering axis.

In assignment with the two roller units 20, 22, roller heaters 32, 34 are respectively deployed on the compactor structure 12. Each of the roller heaters 32, 34 is positioned with respect to the assigned roller unit 20, 22 on its side facing away from the compactor structure 12. This leads to a structure in which the roller heater 32 at the end region 16 is substantially the last component of the compactor 10 in this direction, while the roller heater 34 at the end region 18 substantially provides the last component of the compactor 10 in this direction.

Since the two roller heaters 32, 34 can in principle be constructed identically to one another, their structure and their function are described in detail below with reference to the roller heater 32 assigned to the roller unit 20 deployed in the end region 16.

Figure 3:
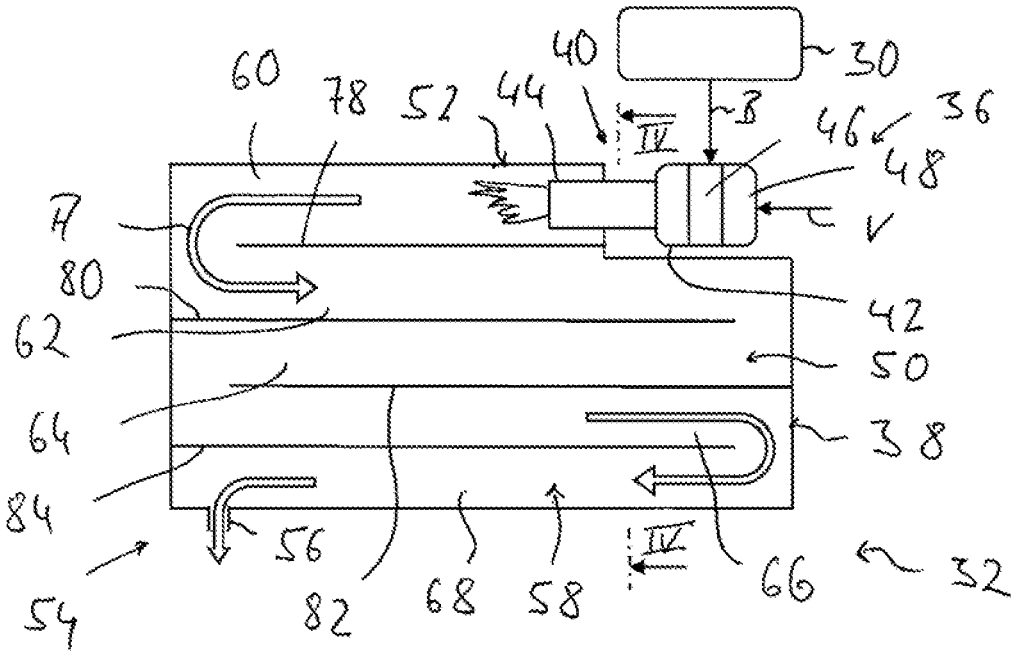
FIG. 3 shows a basic illustration of a roller heater of the compactor shown in FIG. 1.
Figure 4:
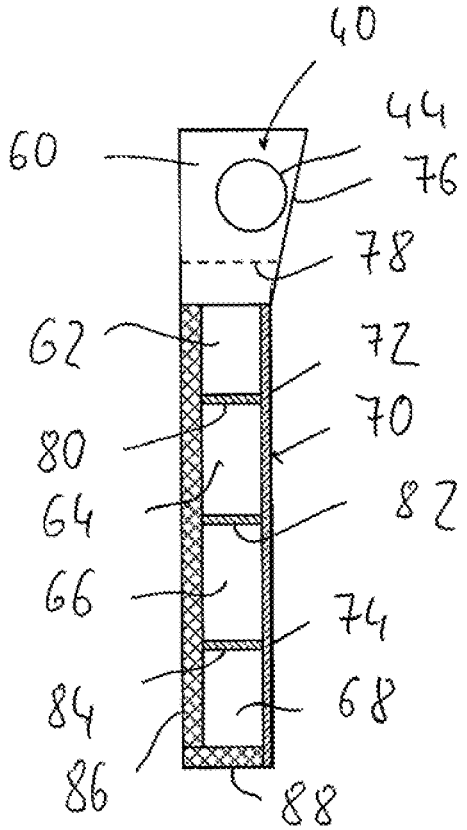
FIG. 4 shows a sectional view of the roller heater of FIG. 3, cut along a line IV-IV in FIG. 3.

The roller heater 32 shown in somewhat more detail in FIGS. 3 and 4 is constructed with two substantial system regions. On the one hand, this is a fuel-operated heating device 36, and on the other hand it is a heating element, generally designated 38. The heating device 36 includes a burner region, generally designated 40. The burner region 40 can be constructed, for example, with a combustion chamber 42 and a flame tube 44 connected to it. Liquid fuel B is led to the combustion chamber 42 by means of a fuel pump 46, for example a metering pump, from the fuel tank 30, from which the drive assembly 28 is also fed. A combustion air blower 48 supplies combustion air V into the combustion chamber, so that a mixture of fuel B and combustion air V is formed in the combustion chamber 42 and is ignited or burned. If the heating device 36 is constructed as an evaporator heater, the liquid fuel B is fed by the fuel pump 46 into a porous evaporator medium, for example an evaporator fleece. The fuel vapour is released into the combustion chamber 42 from this evaporator medium in order to be mixed there with the combustion air V. If the burner region 40 is constructed as an atomising burner, the fuel led by the fuel pump 46 is atomised in the region of an atomising nozzle, so that a very fine mixing of fuel B and combustion air V is likewise achieved in order to be able to provide the mixture required for the combustion.

It should be pointed out that the heating device 36 or its burner region 40 can substantially be constructed, such as auxiliary heaters or independent heaters used in the area of passenger cars, commercial vehicles or buses.

The heating element 38 is substantially box-shaped and provides an exhaust gas flow volume, generally designated 50, in its interior. In an inlet region 52 of the exhaust gas flow volume 50, combustion exhaust gas A arising in the combustion operation enters the exhaust gas flow volume 50 from the burner region 40 or the flame tube 44. After flowing through the exhaust gas flow volume 50, the exhaust gas A leaves the exhaust gas flow volume 50 to the outside in an outlet region 54 via one or more outlet ports 56.

Within the meaning of the present invention, to the outside means that the exhaust gas can be emitted after flowing through the heating element 38 to the environment or to a further exhaust gas routing system. In this case, the exhaust gas A from the heating element 38 appears in a region not facing the assigned roller unit 20, for example a region facing the substrate, from the exhaust gas flow volume 50. This means that the flow of exhaust gas A leaving the exhaust gas flow volume 50 is not directed towards the surface of the roller unit 20, but, as indicated in FIG. 3, directs the exhaust gas flow volume 50 toward the substrate, for example, and leaves with a main flow direction component in the direction oriented away from the roller unit 20.

The exhaust gas flow volume 50 in the heating element 38 is substantially constructed with a flow channel 58 running in a meandering manner between the inlet region 52 and the outlet region 54. In the example shown, the flow channel 58 comprises five adjacent and substantially parallel-running channel portions 60, 62, 64, 66, 68. In the inlet region 52, exhaust gas A leaving the burner region 40 enters the channel section 60. At the end remote from the inlet region 52, the channel section 60 merges into the channel section 62. In the channel section 62, the exhaust gas flows in a flow direction opposite to the flow direction in the channel section 60.

The same also applies to the then successive channel sections 62, 64, 66, 68. In this way, it is ensured that the entire exhaust gas flow volume 50 is flowed through substantially uniformly by the entire exhaust gas flow and thus a substantially uniform heat emission is ensured. In order to take into account the exhaust gas temperature decreasing in the course of the flow through the exhaust gas flow volume 50, which is also accompanied by a decrease in the volume of the exhaust gas flow, the flow cross-section of the successive channel sections 60, 62, 64, 66, 68 can decrease accordingly, as a result of which substantially constant pressure conditions and thus a substantially constant heat transfer, which compensates for the decrease in temperature, is ensured over the entire length of the exhaust gas flow channel 58.

For example, the channel section 60 can provide the largest flow cross-section, while the flow cross-section then decreases in the direction of the last channel section 68 and the channel section 68 provides the smallest flow cross-section.

The heat transported in the exhaust gas through the heating element 38 and transferred to it is emitted in the region of a heat transfer wall 70 facing the assigned roller unit 20 by radiant heat in the direction of the roller unit 20. For this purpose, the heat transfer wall 70 provides a heat emission surface 72 facing the roller unit 20. In adaptation to the circular outer circumferential contour of the roller unit 20, the heat transfer wall 70 or the heat emission surface 72 provided thereby can have an angular structure with surface regions 74, 76 of the heat emission surface 72 that are angled relative to one another. For efficient heat transfer, the heat transfer wall 70 is constructed, for example, from comparatively thin sheet material, which on the one hand has a high conductivity for heat absorbed by the exhaust gas and on the other hand provides good heat radiation capacity. The walls 78, 80, 82, 84 separating the channel sections 60, 62, 64, 66, 68 from one another can also be constructed from such comparatively thin sheet metal material.

In order to avoid heat loss to the outside as much as possible, the heating element 38 is at least partially constructed with an insulation wall 86, 88 on its sides not facing the assigned roller unit 20. Such an insulation wall 86, 88 can for example be provided by a sheet metal wall covered with insulating material or can have a sandwich-like structure in which the insulating material is accommodated between two sheet metal walls or the like. Such insulating material can be constructed, for example, as fibre material or foamed material, as is also used in other areas of vehicles, in order to produce thermal insulation.

The heat generated in the heating device 36 in combustion mode can be efficiently released by the heating element 38 in the form of heat radiation in the direction of the assigned roller unit 20. The heating element 38 of the roller heater 32 positioned on the side of the roller unit 20 facing away from the compactor structure 12 encapsulates the roller unit 20 at least in some regions. In order to improve this encapsulation still further, the end regions of the roller unit 20 lying in the direction of the roller axis of rotation A1 can be covered by the heating element 20 on the end plates 90, 92 adjoining the compactor structure 12, as can be seen in FIGS. 1 and 2 in assignment with the two roller heaters 32, 34, so that a space region that is substantially only open in the downward direction and accommodates the respective roller unit 20, 22 is created.

The heating power provided in the region of the heating device 36 can be varied very finely by the metered supply of fuel B and combustion air V to the combustion chamber 32. It is therefore also possible to adapt the heat provided in the combustion mode to the existing heat requirement by appropriately adapting the heating output. In order to determine this heat requirement, a temperature detection arrangement 94 is shown in FIG. 2, for example in assignment with the roller unit 20. This can comprise one or more temperature sensors 96, which, for example, can detect the surface temperature of the roller unit 20 as optically operating temperature sensors. This temperature information is fed to a control arrangement 98, which sends corresponding control signals to the heating device 36 in order to adapt its heating power to the surface temperature of the roller unit 20. For example, the temperature detection arrangement 94 can include a temperature sensor 96 in assignment with each of the rubber wheels 24. Since it can generally be assumed that the temperatures of all rubber wheels 24 will be approximately at the same level, the detection of the temperature in the region of the surface of one of the rubber wheels 24, for example a centrally positioned rubber wheel 24, may be sufficient. Of course, such a temperature detection arrangement can alternatively or additionally also be assigned to the roller unit 22, so that the heating operation of the roller heater 34 assigned to the roller unit 22 can also be adjusted to the heat requirement.

A switching unit 100 can be deployed in the control station 14, via which an operator can switch one or both roller heaters 34, 36 on and off via the control unit 98. Since the two roller heaters 32, 34 can be operated independently of the drive assembly 28, it is possible to put one or both of the roller heaters 32, 34 into operation before commencing the compacting operation or before starting the drive assembly 24 in order to ensure that already at the beginning of the compaction operation, the respectively assigned roller unit 20, 22 has a surface temperature that substantially prevents the adhesion of asphalt, for example. In this preheating phase, it is not necessary to also operate the drive assembly 28. The electrical energy required for the operation of the roller heaters 32, 34 and also the control unit 98 can be deployed by an energy source, for example a battery, provided on the compactor 10.

FIG. 2 also shows an overheating sensor 102, which can be provided on thermally critical regions of the compactor 10, in particular in the region of the roller heaters 32 or 34. If, during operation of the compactor 10 when the roller heater 32 or/and 34 is activated, the overheating sensor 102 detects a temperature in the region of its surroundings which is above an assigned temperature threshold, at least one of the roller heaters 32, 34 or its heating device 36 is deactivated. For example, only the roller heater 32 or 34 that is positioned closer to the overheating sensor 102 and whose operation is therefore primarily responsible for the occurrence of overheating in the region of this overheating sensor 102 can be deactivated. Such a condition can occur, for example, if, at comparatively low ambient temperatures, even long-term, continuous operation of the roller heaters 32, 34 does not lead to sufficient heating of the roller surfaces, or the heating thereof to a shutdown. Because of the long-term operation, for example with a comparatively large heating output, the temperature in the vicinity of a respective roller heater 32 or 34 can rise so much that other system regions of the compactor 10 can be damaged in this region. One or more such overheating sensors 102 can therefore primarily be deployed in the regions of the compactor 10 which could be damaged by excessive local heating generated by the roller heaters 32, 34.

Such a shutdown of the roller heaters 32, 34 or the heating devices 36 of the same can also take place if an error is detected, for example in the fuel supply or in the combustion air supply. The roller heaters 32, 34 can also be deactivated when it is recognised that the compactor has been idle for a predetermined period of time and is not moved over the surface to be compacted. In this way, uneven, excessive local heating of the roller units 20, 22 can be avoided.

It should be noted that various structural variations can be made while maintaining the principles of the present invention. For example, the fuel pump assigned to a respective heater can be disposed in the line region between the burner region and the fuel tank, detached from the burner region of this heating device. The roller heaters provided at the two end regions of the compactor structure can also be dimensioned differently, adapted to the different design of the roller units deployed there. Where there is basically a higher heat requirement, a larger-sized roller heater can be deployed, for example with a heating device with a larger maximum heating power. If there is sufficient construction space available on the compactor structure and there is a need for a comparatively large amount of fuel, a separate fuel tank can also be deployed for the or each of the roller heaters. This also makes it possible to use a different liquid fuel for the operation of the roller heaters, for example less expensive heating oil.

Since in the compactor according to the invention the roller heaters deployed there are deployed as separate components and, for example, the heat transported in the exhaust gas of the drive assembly is not used, it is possible to make the required heat available in the region of each of the roller heaters regardless of the power requirement for the drive assembly. Nevertheless, in principle it can also be provided that in addition to the exhaust gas flow provided by a respective heating device in the region of the roller heater and transporting heat, the exhaust gas emitted by the drive assembly designed as an internal combustion engine is also fed into the heating element of at least one of the roller heaters, so that the heat transported in this combustion exhaust gas of the drive assembly can also be used to heat the respectively assigned roller unit. The heating device then additionally deployed for a respective roller heater can then be operated in order to provide the additional thermal energy required. If heating of a roller unit is not necessary, the heating device can be deactivated or kept deactivated in such a construction on the one hand, and the exhaust gas flow emitted by the drive assembly can be guided so that it does not enter a respective exhaust gas flow volume.

The invention claimed is:

1. A compactor, comprising a compactor structure and at least one roller unit rotatably supported on the compactor structure about a roller axis of rotation, wherein a roller heater is deployed in assignment with at least one roller unit, wherein the roller heater is a liquid fuel-operated heating device with a burner region, a fuel pump for supplying liquid fuel from a fuel tank to the burner region and a combustion air blower for supplying combustion air to the burner region, the roller heater further comprising a heating element absorbing combustion exhaust gas expelled from the burner region and emitting heat in the direction of the roller unit, an exhaust gas flow volume being formed in the heating element with a combustion exhaust gas inlet region for receiving combustion exhaust gas expelled from the burner region and a combustion exhaust gas outlet region for expelling exhaust gas to the outside, the exhaust gas flow volume comprising a flow channel running at least in regions in a meandering manner between the combustion exhaust gas inlet region and the combustion exhaust gas outlet region, the heating element comprising a heat emission surface positioned facing the assigned roller unit and provided at least partially on a heat transfer wall of the heating element limiting the exhaust gas flow volume.

2. The compactor according to claim 1, wherein a flow of combustion exhaust gas leaving the exhaust gas flow volume is substantially not directed towards the assigned roller unit.

3. The compactor according to claim 1, wherein the exhaust gas flow volume is delimited on at least one side facing away from the assigned roller unit by an insulation wall of the heating element.

4. The compactor according to claim 1, wherein at least one roller unit comprises a plurality of rubber wheels which can be rotated about the roller axis of rotation of this roller unit, wherein the roller unit comprising a plurality of rubber wheels is assigned a roller heater, or/and that at least one roller unit comprises a metal jacket, wherein the roller unit comprising a metal jacket is assigned a roller heater.

5. The compactor according to claim 1, wherein at least one roller heater is disposed on a side of the assigned roller unit facing away from the compactor structure in a longitudinal direction of the compactor.

6. The compactor according to claim 1, wherein in assignment with at least one roller unit, a temperature detection arrangement for detecting a temperature in the region of a roller surface is deployed, and in that the heating device of the roller heater assigned to this roller unit can be operated on the basis of a roller surface temperature detected by the temperature detection arrangement.

7. The compactor according to claim 1, wherein at least one overheating sensor is deployed, wherein if a temperature detected by the at least one overheating sensor exceeds an assigned temperature threshold, at least one roller heater deployed in assignment with a roller unit can be deactivated.

8. The compactor according to claim 1, wherein the flow channel comprises a plurality of adjacent parallel-running channel sections, wherein an exhaust gas flow direction of each one of the channel sections is opposite to the exhaust gas flow direction in an adjacent one of the flow channel portions.

9. The compactor according to claim 8, wherein a flow cross section of flow channel sections following each other in the exhaust gas flow direction decreases.

10. The compactor according to claim 1, wherein a drive assembly is deployed on the compactor structure.

11. The compactor according to claim 10, wherein the drive assembly is designed as an internal combustion engine, and in that the drive assembly and the heating device of the at least one roller heater are fed from the same fuel tank.

12. The compactor according to claim 10, wherein the drive assembly is designed as an internal combustion engine, and wherein the heating element is arranged for receiving exhaust gas emitted by the drive assembly for the flow of the exhaust gas emitted by the drive assembly through the flow channel.

* * * * *